United States Patent [19]

Swann

[11] 4,403,773

[45] Sep. 13, 1983

[54] EXERCISING APPARATUS

[76] Inventor: David T. Swann, 18924 Lomond Blvd., Shaker Heights, Ohio 44122

[21] Appl. No.: 128,654

[22] Filed: Mar. 10, 1980

[51] Int. Cl.[3] ..... A63B 23/04; A63B 23/02

[52] U.S. Cl. ..... 272/134; 272/136; 272/145

[58] Field of Search ..... 272/61, 62, 93, 134–139, 272/143–145

[56] References Cited

U.S. PATENT DOCUMENTS

| | | | |
|---|---|---|---|
| 1,950,174 | 3/1934 | Harrison | 272/134 |
| 1,973,945 | 9/1934 | Chavin et al. | 272/134 |
| 3,708,167 | 1/1973 | Potgieter | 272/134 X |
| 3,947,023 | 3/1976 | Martin | 272/93 |
| 4,198,044 | 4/1980 | Holappa | 272/144 X |

FOREIGN PATENT DOCUMENTS

| | | | |
|---|---|---|---|
| 1428815 | 11/1968 | Fed. Rep. of Germany | 272/144 |
| 1081419 | 6/1954 | France | 272/138 |

*Primary Examiner*—Richard J. Johnson

[57] ABSTRACT

Exercising apparatus with a flat support for the body and having a pair of terminal ends adapted to extend outwardly of the support. The support is provided with securing means disposed about the sides and ends thereof to which tension means may be secured. Detachable exercising devices are adapted to be secured to said secured tension means at the free ends thereof wherefor various selected exercises may be performed by the use thereof depending upon the selected positioning of the tension means and the selection of the particular exercise devices.

2 Claims, 23 Drawing Figures

EXERCISING APPARATUS

My invention relates to exercising apparatus adapted for use and for storage in relatively limited areas and is particularly adapted for use in either simultaneously or individually firming exercises for the arms, legs and trunk of a human being.

Various exercisers have been employed in the past which employ raised platforms or tables and have specially constructed spring means as shown in U.S. Pat. Nos. 1,075,309; 1,518,361; 1,734,238; 3,162,441; 3,162,442; 4,089,520; 4,108,429; and 4,170,351, to provide resistance to movement of the body or body members.

Other U.S. Patents for instance, U.S. Pat. Nos. 1,990,124; 3,731,921 and 3,976,058, disclose apparatus for teaching coordination skills or for developing specific athletic movements, such as swimming.

The apparatus of my invention consists of a body support adapted to be disposed in horizontal position on a firm surface, as on the floor, ground, bed, etc. It is provided with various detachable means adapted to be placed at various selected positions for selected firming exercises.

An object of my invention is to provide an exerciser providing means for engaging in firming exercises for the arms, legs and trunk of a human being.

A further object of my invention is to provide an exerciser wherein a plurality of different flexion, adduction, abduction and extension exercises for a selected member or members or a portion of the trunk can be achieved.

A still further object of my invention is to provide an exerciser of the type referred to which will be inexpensive and simple in manufacture and use and of durable construction.

Another object of my invention is to provide an exerciser of the type referred to which will occupy a minimum of space either during use or in storage.

Yet another object of my invention is to provide an exerciser of the type referred to which is adapted to have a plurality of various exercise attachments selectively secured thereto to afford a wide range of optional exercises and which can be separately stored, as desired.

Other objects of my invention and the invention itself will become more readily apparent from a review of the accompanying description and drawings, in which drawings.

Figure 9:
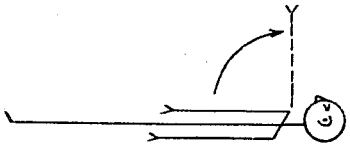
Figure 10:
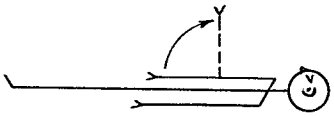
Figure 11:
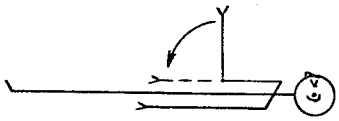

FIGS. 9–11 inclusive are diagrammatic views of various exercise positions of one exercising the arms when said hand grips are attached by tnesion means to fastening means disposed at the sides of the support.

Figure 12:
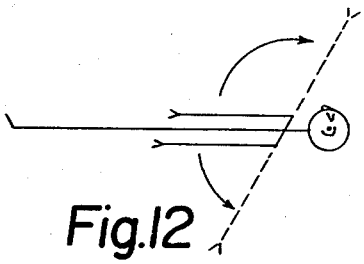
Figure 13:
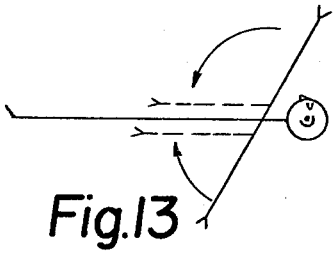
Figure 14:
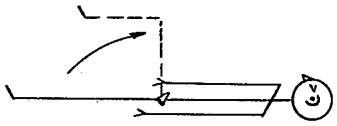
Figure 15:
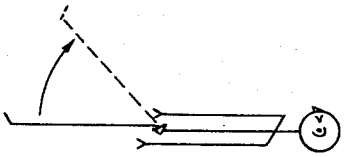
Figure 16:
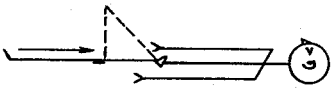
Figure 17:
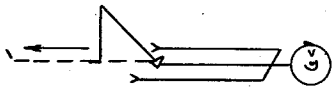
Figure 18:
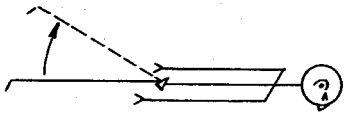
Figure 19:
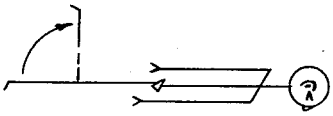
Figure 20:
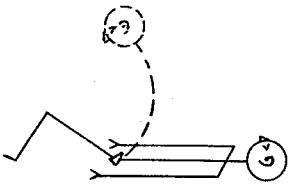
Figure 21:
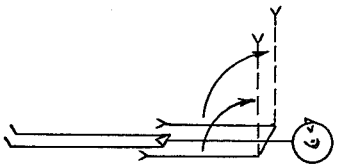
Figure 22:
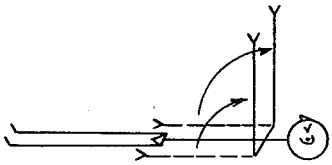

FIGS. 12 and 13 are diagrammatic views of various exercise positions of one exercising the arms when said hand grips are attached by tension means to fastening means disposed outwardly of the support;

FIGS. 14–19 inclusive are diagrammatic views of various optional exercise positions of one exercising the legs, thighs, knees and hips when said person's foot is secured by stirrups, ankle straps, etc. fastening means, etc. to the support by tension means;

FIG. 20 is a diagrammatic view of exercise positions of one secured by chest and shoulder brace means to tension means secured to the support to exercise the back and stomach;

FIGS. 21 and 22 are diagrammatic views of shoulder flexion and shoulder extension exercises using hand grip attachments at the sides of the support or at the ends of the end bars, respectively.

Figure 1:
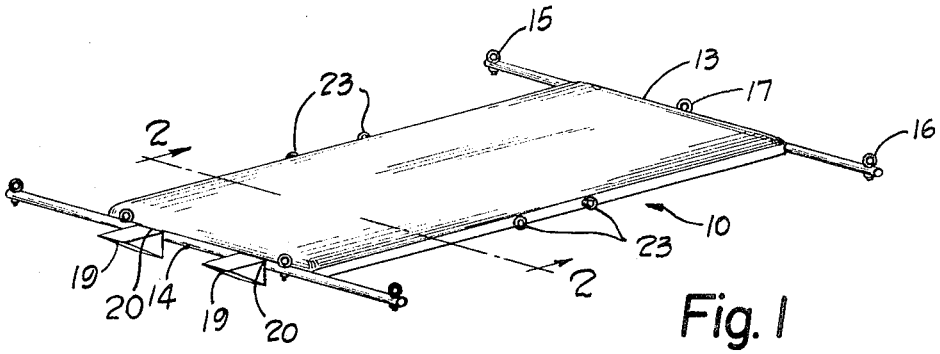
FIG. 1 is a perspective elevational view of an embodiment of the exerciser of my invention.
Figure 2:
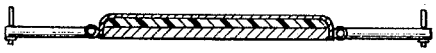
FIG. 2 is a cross-sectional view taken through the lines 2—2 of FIG. 1.
Figure 3:
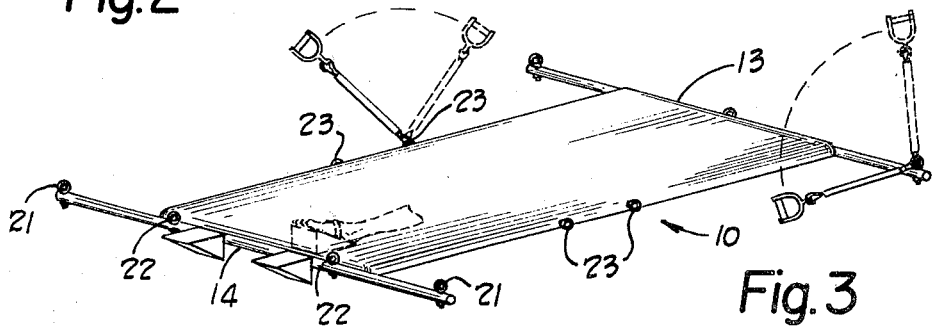
FIG. 3 is a view similar to FIG. 1 showing different adjustment positions of detachable arm and foot extensions secured to tension means.
Figure 23:
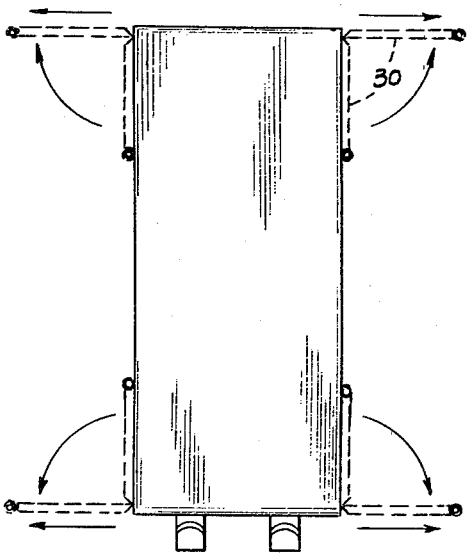

FIG. 23 is a view of the platform of FIGS. 1 and 3 showing foldable arm and leg extensions in extended and folded positions, Referring now to the drawings, in all of which like parts are designated by like reference characters, and referring more particularly to FIG. 1, at 10 is shown a flat elongated rectangular support which may be constructed of plywood or other rigid material and act as a support for a human body in prone or seated position. The support is preferably provided with a covering or pad of relatively soft cushioning material 11 and is provided with a plurality of eye bolts or the like secured thereto at various positions around the periphery of the support.

A pair of parallel spaced end bars 13 and 14 are preferably provided at either end of the support and serve as arm and leg exercisers respectively. The said bars preferably extend laterally outwardly of the ends of said support. The arm exerciser bar 13 is provided with a pair of eye bolts 15, 16 at either end respectively thereof and with an eye bolt 17 centrally thereof, which latter eye bolt 17 is adapted to have chest and shoulder strap means 18 secured thereto.

Figure 4:
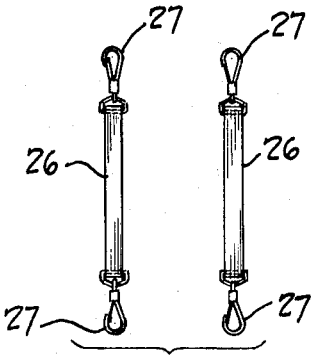
FIG. 4 is a view of tension members adapted to selectively connect hand grips, stirrups, ankle straps or shoulder and chest straps of various exercising apparatus to the support of FIG. 1.
Figure 5:
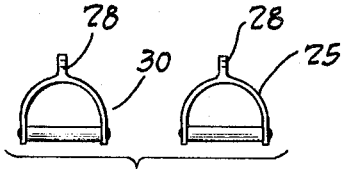
FIG. 5 is a plan view of hand grips adapted to be secured to the support as shown in FIG. 3.
Figure 6:
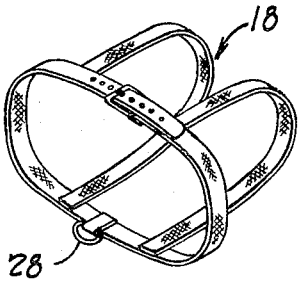
FIG. 6 is a perspective view of a shoulder and chest attachment means adapted to be detachably secured to the support of FIG. 1.
Figure 7:
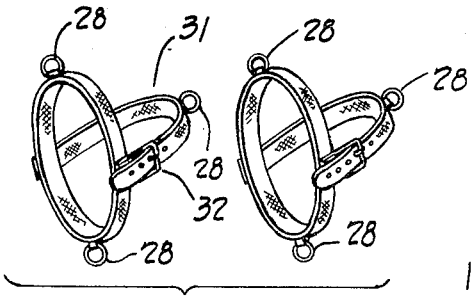
FIG. 7 is a perspective view of ankle straps or stirrups adapted to be secured to the support as shown in FIG. 3.

A hand grip 25 as shown in FIG. 5 is shown in FIG. 3 attached to the eye bolt 16 by tension means 26 of the type shown in FIG. 4 having a snap hook 27 at either end for attachment to the support at one end and to a selected exercising device at the other end. Normally a pair of hand grips 25—25 would be secured to the bar 13 by first securing the tension means 26 to selected eye bolts 15 and 16 by means of a snap hook 27 at one end thereof and by a snap hook 27 at the opposite end of the tension means 26 to rings or eyelets 28 carried by the hand grips Tension means of different strengths can, it will be noted, be employed to vary the amount of tension applied to the arms in moving the same in exercising and in firming the arms and shoulder portions.

The lowermost bar 14 is adapted to have a pair of wedge shaped foot supports 19—19 secured intermediately thereof by hinge means 20 or the like. Said foot supports 19—19 are preferably provided with straps 21 to secure the feet in fixed position while exercising.

The lateral sides of the lower support 14 are provided with eye bolts 21—21 at either of the opposite ends thereof, and with a pair of spaced eye bolts at the median portions there, namely, as indicated at 22. The support 10 further is provided with a pair of spaced eye bolts 23—23 on either sides thereof adjacent a center portion thereof for use when exercising as shown in FIGS. 3, 10, 11, 14–19 inclusive.

In FIG. 23 a second embodiment of the invention is disclosed having extensions 30 hingedly or pivotally secured to the end bars and adapted to be disposed coextensive with the ends of the support and to act as outwardly projecting portions of the bars. Said extensions are adapted to fold and lie adjacent in abutting relation along opposite sides of the support. It is contemplated that the bars might be solid or tubular and might be adapted to be adjustable to different lengths and that the extensions, rather than being folded, might be telescoped within a medial tubular end bar and adapted to be pulled outwardly therefrom and to be locked in various preferred adjusted outward positions.

FIG. 3 is a view similar to that shown in FIG. 1 and illustrates different exercise positions of the arm and foot during exercise. The frame or support 10 of FIG. 1 is adapted to have a plurality of exercising means secured to various eye bolts disposed about the floor support or on the parallel bars, such as arm or leg exercisers 30 and 31 respectively. The arm exercising means 30 generally comprise hand grips as shown at 25; the leg exercising means generally comprise ankle straps as shown at 32. With all such exercisers tension springs 26 are employed which may be of varying tensions strengths i.e. 5 lbs., 10 lbs., 15 lbs., as desired. Said arm and leg exercising means 30 and 31, and chest strap means 18 are provided with loops, clips or the like 28 at a terminal or terminals thereof which are adapted to be hooked by means of end hook fasteners 27, 27 at either end of said tension means to the loops, clips, etc. of various selected exercise attachments, such as the hand grip 30, shoulder and chest strap 35, ankle strap 32, etc. and to a selected eye bolt or bolts carried by the support 33.

In use, suitable firming exercises can be applied to the arm, legs, or trunk and are variously beneficial depending on strategic placement of the attachments. Note as shown in FIG. 3 that the leg is adapted to be selectively connected to the support and to leg exercising means by tension means 26 and that the leg so connected is adapted to be moved toward the chest of the prone exerciser; or the leg may be raised straight to gain flexion of the leg muscles; or moved outwardly and inwardly to secure hip abduction and adduction; and to provide an exercise whereby the feet may be moved towards the hips or toward or away from the hips and/or to move the arm exercising means or leg upward or downward. It is to be noted that the arms when connected to the support by tension means may be firmed by exercises which permit the movement of the arm upward or outwardly from the body and inwardly to the body by moving the hand toward a shoulder and by moving the hand or hands to and from the shoulders to exercise the elbow. It is to be noted that the stomach or the back may be firmed by means of trunk flexion, by means of the permitted movement of the upper body toward the ceiling and/or downwardly and that the device permits such movement. Also the shoulders and upper back may be strengthened by extension.

A series of pictorial views showing a range of movements of various exercises are illustrated in FIGS. 9–23.

The apparatus of the invention affords in marked contrast to prior art, devices a universal range of exercise movements owing to the variations in optional positioning of the exercise devices. It will be observed that flexion, extension, abduction and adduction exercises can be effected.

Figure 8:
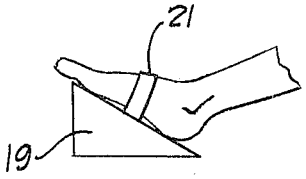
FIG. 8 is a view of a foot anchoring means adapted to be secured to the support.

FIG. 8 shows a foot support adapted to be secured to the end of the support which can be used to elevate the foot, if desired, during exercise.

The support for the apparatus when not in use may be stored in a minimum amount of space, such as under a bed or against a wall of a closet or of a bedroom, or family room, etc. The exercising devices and tension means being detachable therefrom can easily be kept together as in a bag or box andor can be hung from the support of other means.

While I have described my invention in connection with certain preferred embodiments and have shown the exerciser in prone or seated position in the pictorial views, it will become readily apparent that various and numerous departures, such as utilizing the same as a wall supported vertically standing exerciser, or providing different fastening means or attaching exercisers, could be made therefrom without, however, departing from the spirit of my invention or the scope of the appended claims.

What I claim is:

1. An exercise apparatus comprising an elongated rectangular flat and immovable support during use of said apparatus, anchoring means secured to said support at backend thereof and at intermediate portions lengthwise thereof, a plurality of detachable exercise means having connecting means adapted to be selectively secured to an arm and/or leg, tension means having fastening means at each end thereof adapted to be secured to said detachable exercise means and to selected said anchoring means said support being provided at each end with laterally outwardly extended arms having additional anchoring means at the ends thereof for arm and/or leg firming exercises when said spring tension arm and/or leg exercise means are secured to said additional anchoring means to selectively afford flexion, adduction and extension exercises of the selected terminal or torso portions of the unrestrained body of an exerciser.

2. The exercise apparatus of claim 1 wherein the detachable exercise means are hand grip means.

* * * * *